United States Patent [19]

Lee

[11] Patent Number: 4,627,769

[45] Date of Patent: Dec. 9, 1986

[54] CONCRETE FOUNDATION PILE

[76] Inventor: Paul Lee, 602-608 Nathan Rd., 19th Fl., Kowloon, Hong Kong

[21] Appl. No.: 218,711

[22] Filed: Dec. 22, 1980

[30] Foreign Application Priority Data

Jan. 14, 1980 [GB] United Kingdom ..... 8001147

[51] Int. Cl.[4] ..... E02D 5/30; E02D 7/02

[52] U.S. Cl. ..... 405/256; 405/232; 405/255

[58] Field of Search ..... 405/232, 239, 251, 252, 405/255, 256; 52/223 R, 223 L, 227, 228, 726

[56] References Cited

U.S. PATENT DOCUMENTS 3,248,888 5/1966 Williams ..... 405/232
3,899,891 8/1975 Kelly et al. ..... 405/251

FOREIGN PATENT DOCUMENTS 842180 of 1952 Fed. Rep. of Germany ..... 405/256
1144653 1/1963 France ..... 405/256
862914 of 1961 United Kingdom ..... 405/256
1409188 of 1975 United Kingdom ..... 405/232

*Primary Examiner*—Thomas F. Callaghan
*Assistant Examiner*—Nancy J. Stodola
*Attorney, Agent, or Firm*—Larson and Taylor

[57] ABSTRACT

A concrete foundation pile has a concrete body with reinforcing bars, a steel anchorage plate, a steel capping plate and a removable reinforcing bar which is anchored to the anchorage plate and whose end is located in a recess in the cappling plate. The reinforcing bar can be releasably coupled to the bar of an aligned pile to tension the composite pile formed from a plurality of aligned piles. The capping plate takes hammer blows applied to the upper end of the pile and the upper end of the bar is protected in the recess. The reinforcement is densest immediately below the anchorage plate and steel capping plate.

7 Claims, 5 Drawing Figures

CONCRETE FOUNDATION PILE

This invention relates to a concrete foundation pile which can be presstressed by a central bar. The central bar provides the pile with additional strength which it requires to avoid damage during transport between the casting location and the location of use, and during the time the pile is being driven into the ground. Once the pile has been driven into the ground, it does not require such great strength, and it has been proposed in British patent specification 1 409 235 that the central bar should be removable for re-use in other piles. The earlier specification describes a prefabricated concrete foundation pile suitable for driving into the ground by vibration, but it is an object of the present invention to provide a concrete foundation pile which is suitable for driving into the ground by hammer blows. The construction of the head of the pile of the earlier specification is not suitable for such use.

According to the present invention there is provided a concrete foundation pile comprising a steel anchorage plate set in concrete forming the pile, a central reinforcement bar within the pile, releasably connected to the steel anchorage plate for prestressing the pile, and a capping plate over the steel anchorage plate, the capping plate being formed with a recess for access to the bar.

With this arrangement, the capping plate will receive and transmit to the pile the hammer blows used for driving the pile into the ground, and the end of the reinforcement bar will be protected from the hammer blows within the recess of the capping plate so as to allow the bar to be released from the anchorage plate after the pile has been driven into position. If the bar were connected to the anchorage plate by nuts screwed onto a threaded end portion of the bar and the bar were not protected within the recess of the capping plate, the threaded portion would be so damaged by the hammer blows that it would be impossible to unscrew the nuts from the bar after driving of the pile into the ground.

The pile is preferably provided with a spiral reinforcing bar adjacent the anchorage plate and encircling the central bar within the concrete. The pile is preferably made from lightweight concrete, which is defined as being concrete formed by mixing lightweight artificial coarse aggregate with lightweight artificial fine aggregate or sand and granite fines or other fine aggregate to produce concrete having a density lower than that of normal concrete, varying from 75% to 50% of the weight of normal concrete. The lightweight concrete has a similar strength to that of normal concrete so that the strength to weight ratio of piles manufactured from lightweight concrete is higher.

An example of the invention will now be described with reference to the accompanying drawings in which.

Figure 1:
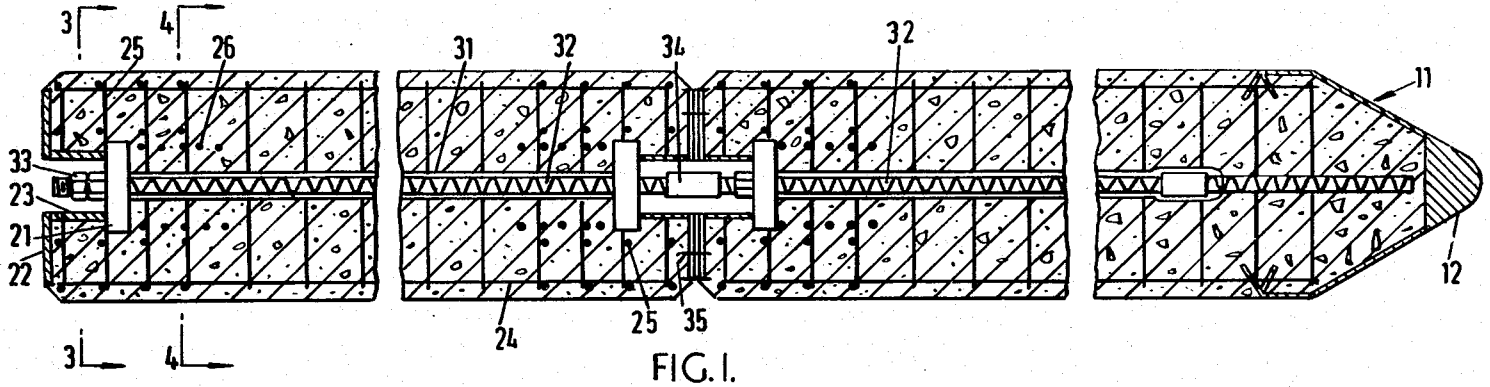
FIG. 1 is a transverse longitudinal section through two joined sections of a concrete foundation pile.
Figure 5:
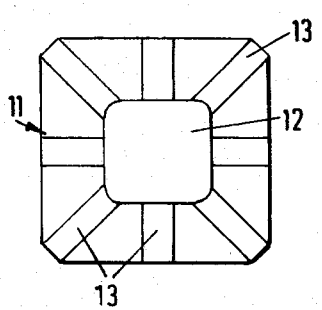
Figure 4:
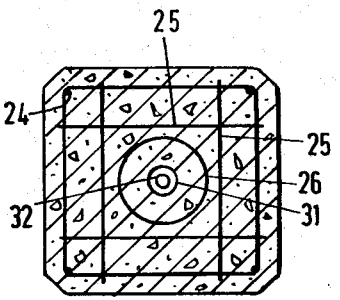
Figure 3:
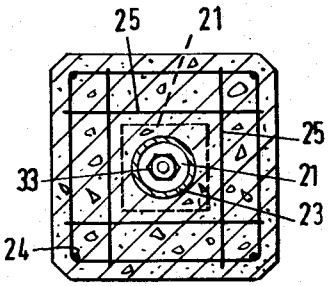
Figure 2:
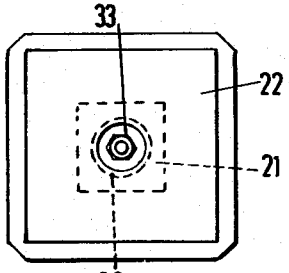
FIG. 2 is a plan view of the pile of FIG. 1.

FIGS. 3 and 4 are sections on lines 3—3 and 4—4 of FIG. 1 respectively, and;

FIG. 5 is an underplan view of the pile of FIG. 1.

The pile shown in FIG. 1 is formed in sections since it is easier to handle short sections of a pile and to assemble the sections as the pile is progressively driven into the ground in order to avoid the difficulties of transporting a complete pile through crowded streets and providing a very tall pile driving mechanism. However, the present invention is equally applicable to a pile formed as a single section.

The right hand section of the pile shown in FIG. 1 is intended to form the lowest section of the pile and is provided with a tapered nose 11 which is shown in underplan view in FIG. 5. The nose 11 has a steel cap 12 at its end, and reinforcing bars 13 extend at 45° intervals around the pile from the cap 12 to and just beyond the transition of the nose 11 to the portion of the pile of constant cross section.

At the other end of the right hand section of the pile shown in FIG. 1, and at both ends of all other sections of the pile, the pile is formed wth a steel anchorage plate 21 150 mm square and 40 mm thick and a steel capping plate 22 340 mm square and 6 mm thick with a central aperture lined by a 100 mm diameter steel tube 23 extending between the facing surfaces of the plates 21 and 22.

The pile sections are generally reinforced by a rectangular grid of reinforcing bars with longitudinal components 24 extending the whole length of the section at about 30 mm below the concrete surface which is of square cross-section having 400 mm sides and bevelled edges. At the ends of the sections (except for the nose end of the lowest section) additional reinforcement is provided by a rectangular mesh of bars 25 extending approximately equal distances on either side of the plate 21 at about 100 mm from the central axis of the pile. Further reinforcement is provided on the interior side of the plate 21 by a spring core 26 of 150 mm diameter, the turns of the spring occurring at about 75 mm spacing, the spring being about 300 mm long. As the diameter of the spring 26 is the same as the width of the anchorage plate, the spring 26 provides a reinforcement under the edges of the plate 21.

Along the centre of each section there is provided a hollow sheathing 31 within which can be located a threaded prestressing bar 32. The bar 32 passes through apertures in the anchorage plates 21 and is secured in position above the upper anchorage plate 21 by a pair of lock nuts 33. In and adjacent the nose portion 11 of the pile, no sheathing 31 is provided and the bar 32 is cast permanently in the concrete of the pile. Within the constant diameter portion of the lowest pile, a coupler 34 is provided to couple the non-recoverable bar to a further bar which extends within sheathing 31 to the upper end of this section. When only a single section of pile is used, it is possible to apply a twist to lock nuts fastened on the bar 32 beyond the plate 21 to remove the bar 32 from within the sheathing. When more than one section of the pile is used, as shown in FIG. 1, a coupler 34 is provided to couple the two bars 32 of the two sections in order to stress the section of the pile together during the driving of the pile. When the pile has been fully driven into the ground, the bar 32 of the top section only can be unscrewed by applying a twist to the lock nuts at its upper end so that that bar 32 is unscrewed at the coupler joining the top section from the next section, but the bars 32 of the remaining sections will remain within the sections and are not recoverable.

When a section of the pile has been driven into the ground and a further section is to be added to the pile, the upper lock nut at the top of the bar is unscrewed, and a screwed coupler is attached in its place. Dowel pins 35 are located in the capping plate 22 to locate the lower capping plate of the next section correctly on the driven section, and the capping plates are covered with epoxy resin putty having a corrosion inhibitor. The next section of pile which has been provided with its own bar 32 for prestressing during transport to the site, has locking nuts at its lower end removed so that the lower end of the bar 32 can be screwed into the coupler placed in position at the top end of the bar 32 of the driven pile and the lower end of the additional section is located on the driven pile by the dowel pins 35 and stuck in position by the putty. The whole pile including the additional section is stressed by screwing down the locknuts at the top end of the bar 32 of the additional section and the driving process is resumed.

The central bar is tensioned after casting, so as to provide the pile with additional strength during removal from the casting mould, transport to site and driving into the ground.

The dimensions of the pile shown in the drawings are given by way of example only and are not intended to be limiting.

What is claimed is:

1. A concrete pile comprising a concrete body, an end wall of the concrete body having a recess therein, a steel anchorage plate set in the concrete body and having at least a portion of one face thereof exposed in said recess, a central reinforcement bar within the body releasably connected to the steel anchorage plate, a capping plate disposed over the end wall of the body, the capping plate being formed with an opening for access to the recess and the reinforcement bar and a steel tube lining the recess and extending from beneath the capping plate to the face of the anchorage plate so that the load of hammer blows on the capping plate are spread to the anchorage plate through the steel tube.

2. A pile as claimed in claim 1 wherein the body is provided with reinforcing bars, the bars being more closely spaced adjacent opposite ends of the body.

3. A pile as claimed in claim 1 wherein the body is provided with a reinforcing bar assembly providing support for the anchorage plate with the body.

4. A pile as claimed in claim 3 wherein the bar assembly comprises a helical reinforcing bar whose diameter is approximately equal to the width of the anchorage plate.

5. A pile as claimed in claim 1 wherein the capping plate is formed with apertures to receive locating pins to locate one said pile on another said pile.

6. A pile as claimed in claim 1 comprising a said steel anchorage plate and a said capping plate at each end of the said body, the bar extending between the anchorage plate at each end of the body.

7. A pile as claimed in claim 1 wherein the body is formed of lightweight concrete.

* * * * *